United States Patent [19]

Yasui et al.

[11] Patent Number: 4,517,494

[45] Date of Patent: May 14, 1985

[54] SCREENING STRUCTURE FOR A CATHODE RAY TUBE DISPLAY

[75] Inventors: Toru Yasui, Nara; Haruo Nakatsuji, Ikoma, both of Japan

[73] Assignee: Sharp Kabushiki Kaisha, Osaka, Japan

[21] Appl. No.: 438,504

[22] Filed: Nov. 2, 1982

[30] Foreign Application Priority Data

Nov. 9, 1981 [JP] Japan ..... 56-180181

[51] Int. Cl.[3] ..... H01J 1/52; H01J 5/02

[52] U.S. Cl. ..... 315/85; 313/240; 313/479; 358/245; 315/8

[58] Field of Search ..... 315/8, 85; 313/279, 313/240, 241, 242, 479; 358/245, 254

[56] References Cited

U.S. PATENT DOCUMENTS

| | | | |
|---|---|---|---|
| 3,265,920 | 8/1966 | Fiore | 313/240 |
| 3,431,454 | 3/1969 | Sanders | 315/85 X |
| 3,720,781 | 3/1973 | West | 315/85 |
| 3,887,833 | 6/1975 | Yamazaki | 315/8 |
| 4,392,083 | 7/1983 | Costello | 315/85 |

OTHER PUBLICATIONS

IBM Technical Disclosure Bulletin, vol. 21, No. 5, Oct. 1978, "Electromagnetic Wave Trap for CRT Video Emanation", by Harder et al., 313-479.

*Primary Examiner*—Saxfield Chatmon

*Attorney, Agent, or Firm*—Birch, Stewart, Kolasch & Birch

[57] ABSTRACT

A screening structure for a cathode ray tube display includes at least a cathode ray tube pin socket, a cathode ray tube input pin and a video amplifier section joined as one body and enveloped with a first screening member which has high conducting characteristics, and a cathode ray tube cathode section enveloped with a second screening member which has high conducting characteristics, the first and second screening members being connected as one body in order that they may be maintained at the same high frequency potential. The screening members are joined to the standard potential part of the cathode ray tube display by a cable having a low high-frequency impedance.

2 Claims, 2 Drawing Figures

SCREENING STRUCTURE FOR A CATHODE RAY TUBE DISPLAY

BACKGROUND OF THE INVENTION

The present invention relates to a new screening structure for a cathode ray tube display apparatus (hereinafter referred to as a CRT display).

A CRT display receives high frequency (several MHz to several tens of MHz) pulse signals from a computer or similar type of equipment by means of a cable, and because of this there is considerable radiation of electromagnetic waves from the CRT display which has an adverse effect on the operation of the computer or other electronic equipment.

In order to improve this adverse effect on electronic equipment caused by the radiation of these undesirable electromagnetic waves, regulations concerning their radiation have been put forward by such bodies as the FTZ, SABS, CISPR, and FCC.

In conventional CRT displays, the CRT pinsocket and video amplifier circuit are made as a single entity, and in order to prevent the emission of undersirable radiation, unless special complete screening is carried out, these units are unable to satisfy the abovementioned regulations pertaining to undesirable radiation.

OBJECT AND SUMMARY OF THE INVENTION

The present invention provides a new type of screening structure which almost completely eliminates the undesirable radiation caused by the video signal from the CRT display, and satisfies the above-mentioned regulations concerning the emission of undesirable radiation.

Other objects and further scope of applicability of the present invention will become apparent from the detailed description given hereinafter. It should be understood, however, that the detailed description of specific examples, while indicating preferred embodiments of the invention, are given by way of illustration only, since various changes and modifications within the spirit and scope of the invention will become apparent to those skilled in the art from this detailed description.

In one embodiment of the present invention, at least a CRT pin socket, a CRT input pin and a video amplifier section are joined as one body and enveloped with a first screen, and a CRT cathode section is enveloped with a second screen which has high conducting characteristics, and the first and second screen members are joined to the part of the CRT display at standard potential by means of a connecting line. This construction provides a screening structure of the CRT display according to the present invention.

BRIEF DESCRIPTION OF THE DRAWINGS

The present invention will be better understood from the detailed description given hereinbelow and the accompanying drawings which are given by way of illustration only, and thus are not limitative of the present invention and wherein.

The drawings show one embodiment of the screening structure of the CRT display, according to the present invention.

DETAILED DESCRIPTION OF THE INVENTION

The following is a detailed description of one embodiment of the present invention, with reference to the accompanying drawings.

Figure 1:
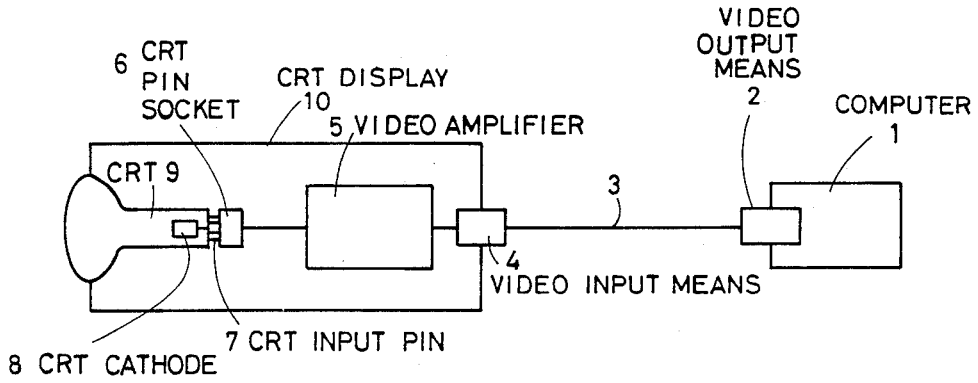
FIG. 1 is a block diagram of a transmission circuit carrying a video signal to a CRT display.

FIG. 1 is a block diagram of a transmission circuit carrying a video signal to a CRT display according to the present invention. The configuration shown in the drawing is comprised of a computer 1, a video output section 2, and a video input section 4, a cable 3 which joins the video output section 2 and the vido input section 4, a video amplifier section 5, a CRT pinsocket 6, CRT input pins 7, a CRT cathode 8, a CRT 9, elements 4-9 comprising a CRT display 10.

The video signal from the usual personal computer now in use has a maximum frequency of several MHz, and, as a base, the high frequency radiation reaches several hundred MHz.

The parts which radiate electromagnetic waves are the video output section 2 of the computer 1, the cable 3, the video input section 4 of the CRT display 10, the video amplifier section 5, the CRT pinsocket 6, the CRT input pins 7, and the CRT cathode 8, and it has been discovered that in order to completely eliminate this electromagnetic wave radiation, the entire area must be screened and at the same time it is necessary to maintain each screen section at the same high frequency potential.

It has also been discovered that if, among these conditions, even one is lacking, the desired screening of electromagnetic wave radiation will, for the most part, not be obtained.

Figure 2:
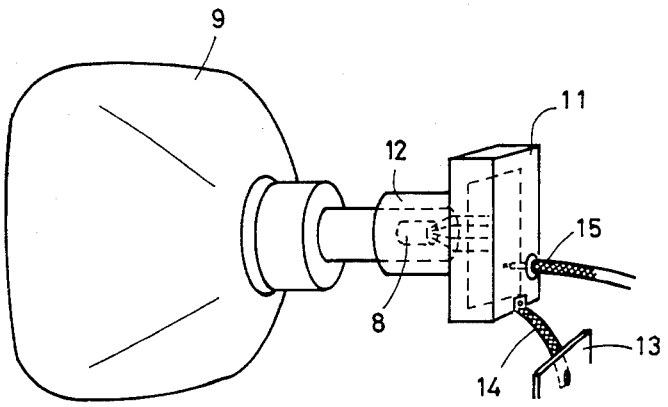
FIG. 2 is a perspective drawing showing the screening structure of a CRT display according to the present invention.

The screening structure according to the present invention fulfills these conditions completely, one embodiment being shown in FIG. 2.

The CRT input pins 7 of the CRT 9 are connected to the CRT pin socket 6 of the video amplifier section 5, and the video amplifier section 5, with the CRT pinsocket 6 and the CRT input pins 7 are provided with a metal case 11 to screen them, while at the same time a metal tube 12 is provided to screen the CRT cathode 8 around its circumference. In addition, the metal case 11 and the chassis ground plate 13 are joined by a connecting cable 14 which maintains the metal case 11 and the chassis ground plate 13 at the same high frequency potential, and at the same time, the screening conductor 15 of the cable 3 is joined to the metal case 11.

The abovementioned connecting cable 14 is constructed of a thick conductor so its high frequency impedance is low.

In addition, the above mentioned metal tube 12 is constructed so that it forms a single unit with the metal case 11, and furthermore, it is constructed with a larger diameter than that of the glass tube of the CRT 9 so that an adequate clearance will be maintained between the metal tube 12 and the glass tube of the CRT 9 in order to provide for good heat dissipation.

Satisfactory results are also obtained if the abovementioned metal case 11 and the metal tube 12 are constructed of perforated metal sheet.

With the above construction, the screening conductor 15 of the cable 3, the metal case 11 and the metal tube 12 can all be maintained at the same high frequency potential, and furthermore, because of this, the entire section comprising the video output section 2, the cable 3, the video input section 4, the video amplifying section 5, the CRT pin socket 6, the CRT input pins 7, and the CRT cathode 8 is screened, and the radiation of undesirable electromagnetic waves can be almost entirely prevented.

the invention described above prevents undesirable radiation of electromagnetic waves when the CRT display is being used, prevents electric radiation problems in the vicinity of the CRT display, and provides stable operation of the computer and associated equipment, while at the same time it satisfied FTS, CISPR, SABS, and FCC regulations concerning undesirable radiation, and gives superior results in solving these problems.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A screening structure for preventing radiation of electromagnetic waves from a cathode ray tube display comprising:

at least a cathode ray tube pin socket, a cathode ray tube input pin and a video amplifier section joined as one body and enveloped with a first screening member which has high conducting characteristics;

a cathode ray tube cathode section enveloped with a second screening member which has high conducting characteristics, said first and second screening members being in electrical contact with each other;

cable means connected to said amplifier section for providing a video signal thereto and enveloped by a third screening member which has high conducting characteristics, said first and third screening members being in electrical contact with each other; and means having a low high-frequency impedance for joining said first, second and third screening members to the standard potential part of the cathode ray tube display.

2. A screening structure for preventing radiation of electromagnetic waves from a cathode ray tube display according to claim 1, wherein first and second screening members are constructed as one body, and said second screening member surrounds and is spaced from a glass tube of the cathode ray tube.

* * * * *